US011194269B2

(12) United States Patent
Yamana

(10) Patent No.: US 11,194,269 B2
(45) Date of Patent: Dec. 7, 2021

(54) IMAGE FORMING APPARATUS, METHOD, AND STORAGE MEDIUM

(71) Applicant: CANON KABUSHIKI KAISHA, Tokyo (JP)

(72) Inventor: Kentaro Yamana, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/823,125

(22) Filed: Mar. 18, 2020

(65) Prior Publication Data

US 2020/0310306 A1 Oct. 1, 2020

(30) Foreign Application Priority Data

Mar. 27, 2019 (JP) ..... JP2019-061554

(51) Int. Cl.
*G03G 15/16* (2006.01)
*G03G 15/01* (2006.01)

(52) U.S. Cl.
CPC ..... *G03G 15/1615* (2013.01); *G03G 15/0136* (2013.01)

(58) Field of Classification Search
CPC ..... G03G 15/1615; G03G 15/1685; G03G 15/167; G03G 15/0136
See application file for complete search history.

(56) References Cited

U.S. PATENT DOCUMENTS

2009/0257764 A1* 10/2009 Okamoto ..... G03G 15/5029 399/66
2011/0255910 A1* 10/2011 Sekine ..... G03G 15/1605 399/313
2014/0023387 A1* 1/2014 Goto ..... G03G 15/167 399/66
2014/0199089 A1* 7/2014 Ishikawa ..... G03G 15/6558 399/45
2017/0031294 A1* 2/2017 Oikawa ..... G03G 15/167

FOREIGN PATENT DOCUMENTS

JP 2007-010742 A 1/2007
JP 2011-227190 A 11/2011
JP 2014-134718 A 7/2014
JP 2014-191100 A 10/2014

OTHER PUBLICATIONS

Machine Translation of JP2007-010742. Jan. 18, 2007. (Year: 2007).*

* cited by examiner

*Primary Examiner* — Carla J Therrien
(74) *Attorney, Agent, or Firm* — Canon U.S.A., Inc. I.P. Division

(57) ABSTRACT

An image forming apparatus includes an intermediate transfer belt, a plurality of rollers including an inner roller and where the intermediate transfer belt is stretched, an outer roller provided at a position facing the inner roller with the intermediate transfer belt in between, and an arm member. The intermediate transfer belt receives transfer of a toner image. The outer roller forms a transfer nip to transfer the toner image from the intermediate transfer belt to a recording medium. The arm member rotatably supports both end parts of the inner roller. When the inner roller is positioned at a first rotating position, the transfer nip is formed at a first position in an outer roller circumferential direction, and when the inner roller is positioned at a second rotating position, the transfer nip is formed at a second position different from the first transfer nip position in the outer roller circumferential direction.

8 Claims, 7 Drawing Sheets

IMAGE FORMING APPARATUS, METHOD, AND STORAGE MEDIUM

BACKGROUND

Field

The present disclosure relates to an intermediate transfer type image forming apparatus that forms an image by using an intermediate transfer belt.

Description of the Related Art

In an image forming apparatus using an intermediate transfer system, a toner image formed by an image forming unit is transferred to an intermediate transfer belt by a primary transfer portion. When a recording medium such as a paper medium passes through a secondary transfer portion (secondary transfer nip) that includes the intermediate transfer belt and a secondary transfer member, the toner image is secondarily transferred to the recording medium. In the secondary transfer portion, there is formed a nip portion that includes an opposed roller around which the intermediate transfer belt is stretched and the secondary transfer member (secondary transfer outer roller or secondary transfer belt) provided at a position facing the opposed roller with the intermediate transfer belt in between. In a case of a thin sheet, separation failure in which a sheet and the intermediate transfer belt are adhered to cause jam occurs on a downstream side of the nip portion in a sheet conveyance direction, depending on a shape of the nip portion.

In a case of a thick sheet, when a trailing end of the sheet passes through a guide disposed on the upstream side of the nip portion in the sheet conveyance direction, the trailing end of the sheet collides with the intermediate transfer belt due to stiffness of the sheet to disturb posture of the belt near the nip portion, which may cause defective image at the trailing end of the sheet.

Thus, the existing technique discussed in Japanese Patent Application Laid-Open No. 2014-134718 includes a changing unit that changes a nip width of the secondary transfer member based on a sheet type to reduce occurrence of defective image.

In a case where one of the secondary transfer member and the opposed roller is slid in a direction intersecting with a nip pressing direction as with the technique discussed in Japanese Patent Application Laid-Open No. 2014-134718, it is necessary to slide the secondary transfer member or the opposed roller while receiving large normal force of a nip pressing force and a force received from tension of the intermediate transfer belt. Thus, if a low-cost sliding configuration (e.g., boss that slides in a groove) is used, a surface property of a sliding surface deteriorates due to friction, which induces operation failure and deterioration in positional accuracy of the roller included in the nip. On the other hand, if a device such as a slide rail is used to avoid the sliding configuration, the cost increases.

SUMMARY

The present disclosure is directed to stabilization of operation of a mechanism that changes a shape of a secondary transfer nip at a low cost.

According to an aspect of the present disclosure, an image forming apparatus includes an intermediate transfer belt configured to receive transfer of a toner image, a plurality of rollers where the intermediate transfer belt is stretched, wherein the plurality of rollers includes an inner roller provided in contact with an inner surface of the intermediate transfer belt, an outer roller provided at a position facing the inner roller with the intermediate transfer belt in between, and configured to form a transfer nip to transfer the toner image from the intermediate transfer belt to a recording medium, and an arm member provided to be rotatable about a rotating shaft, and configured to rotatably support both end parts of the inner roller, wherein the inner roller is movable to a first rotating position and a second rotating position different from the first rotating position by rotating of the arm member, and wherein, when the inner roller is positioned at the first rotating position, the transfer nip is formed at a first transfer nip position in a circumferential direction of the outer roller, and when the inner roller is positioned at the second rotating position, the transfer nip is formed at a second transfer nip position different from the first transfer nip position in the circumferential direction of the outer roller.

Further features of the present disclosure will become apparent from the following description of exemplary embodiments with reference to the attached drawings.

DESCRIPTION OF THE EMBODIMENTS

Exemplary embodiments of the present disclosure are described below with reference to drawings; however, the present disclosure is not limited to the following exemplary embodiments.

Image Forming Apparatus

Figure 1:
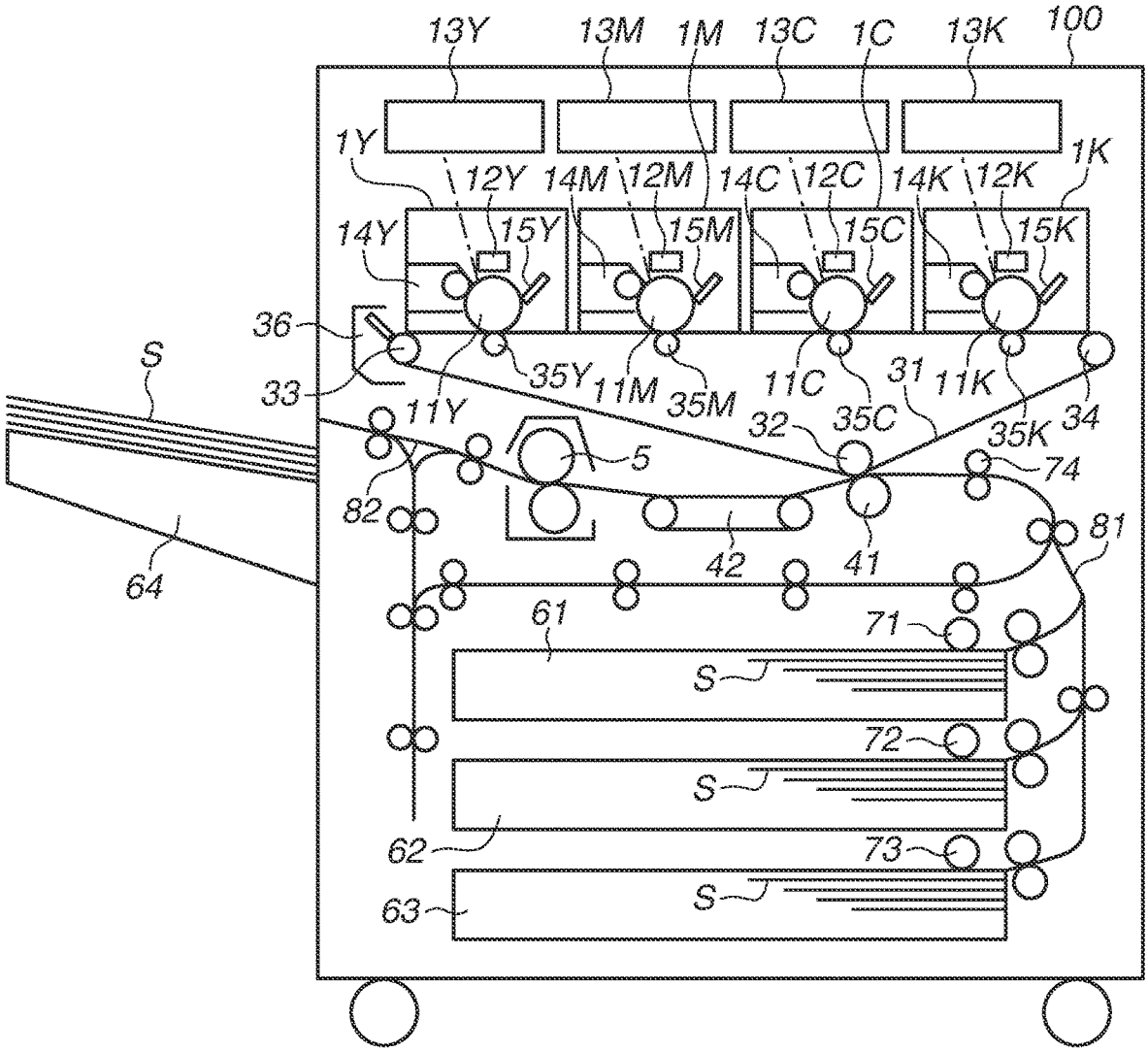
FIG. 1 is a diagram schematically illustrating a configuration of an image forming apparatus.

FIG. 1 is a configuration diagram schematically illustrating a cross section of an image forming apparatus according to a first exemplary embodiment.

An image foxing apparatus 100 is an image forming apparatus of a tandem intermediate transfer system in which image forming units 1Y, 1M, 1C, and 1K are arranged in series in a horizontal portion of an intermediate transfer belt 31, The image forming apparatus 100 forms a full-color image on a sheet material S by an electrophotographic method based on an image signal transmitted from an external apparatus.

The image forming units 1Y, 1M, 1C, and 1K form color toner images of yellow, magenta, cyan, and black on photosensitive drums 11Y, 11M, 11C, and 11K, respectively, and primarily transfer the toner images to a same image position on the intermediate transfer belt 31.

The intermediate transfer belt 31 rotates while being stretched around a driving roller 33, a tension roller 34, and an opposed roller 32 that performs secondary transfer, Primary transfer rollers 35Y, 35M, 35C, and 35K that perform primary transfer are disposed at positions facing the respective photosensitive drums 11Y, 11M, 11C, and 11K on an inner peripheral surface side of the intermediate transfer belt 31.

A charger 12Y that uniformly charges a surface of the photosensitive drum 11Y on which the yellow toner image is formed, and an exposure device 13Y that emits image light to the photosensitive drum 11Y to form a latent image on the surface of the photosensitive drum 11Y are provided near the photosensitive drum 11Y. Further, a developer 14Y that transfers toner to the latent image on the photosensitive drum 11Y to form a toner image, and a cleaning device 15Y that removes toner remaining on the photosensitive drum 11Y after the primary transfer of the toner image are provided near the photosensitive drum 11Y. Configurations for forming the toner images of magenta, cyan, and black can be understood by replacing a suffix Y with M, C, and K in the above description.

Each sheet material S stored in feeding cassettes 61, 62, and 63 is conveyed to a feeding conveyance path 81 when any of feeding rollers 71, 72, and 73 rotates. A registration roller 74 feeds the sheet material S to a secondary transfer portion, which is a nip portion between a secondary transfer roller 41 and the opposed roller 32, to coincide timing of the toner image on the intermediate transfer belt 31, and the toner image is formed on the sheet material S by the secondary transfer portion, Transfer residual toner remaining on the intermediate transfer belt 31 after the secondary transfer is removed by a cleaning device 36.

Next, the sheet material S on which the toner image has been transferred is conveyed to a heat fixing device 5 by a conveyance belt 42. The toner image is stuck to a surface of the sheet material S, and the full-color image is fixed through pressurization under heating by the heat fixing device 5. The resultant sheet material S is fed out to a discharge tray 64 through a discharge conveyance path 82.

Secondary Transfer Portion

The secondary transfer portion of the image forming apparatus according to the present exemplary embodiment is described with reference to FIG. 2.

The secondary transfer roller 41 is offset from the opposed roller 32 with respect to a stretched line T of the intermediate transfer belt 31 before the nip portion. The stretched line T is determined by the intermediate transfer belt 31 being stretched by the opposed roller 32 and a pre-secondary-transfer roller 37. An offset distance X is defined by a distance between a perpendicular line drawn from a center of the opposed roller 32 to the stretched line T and a perpendicular line drawn from a center of the secondary transfer roller 41 to the stretched line T. FIG. 2 illustrates a case where the opposed roller 32 is offset from the secondary transfer roller 41 on a downstream side in a rotation direction of the intermediate transfer belt 31. In the present exemplary embodiment, the offset distance X is defined as positive in the case where the opposed roller 32 is offset from the secondary transfer roller 41 on the downstream side in the rotation direction of the intermediate transfer belt 31, There is a case where a pressing member that presses the intermediate transfer belt 31 from an inner surface side toward an outer surface side is provided between the opposed roller 32 and the pre-secondary-transfer roller 37. In this case, an offset amount is determined for a tangent (hypothetical line) contacting the intermediate transfer belt 31 out of common tangents of the opposed roller 32 and the pre-secondary-transfer roller 37.

Figure 2:
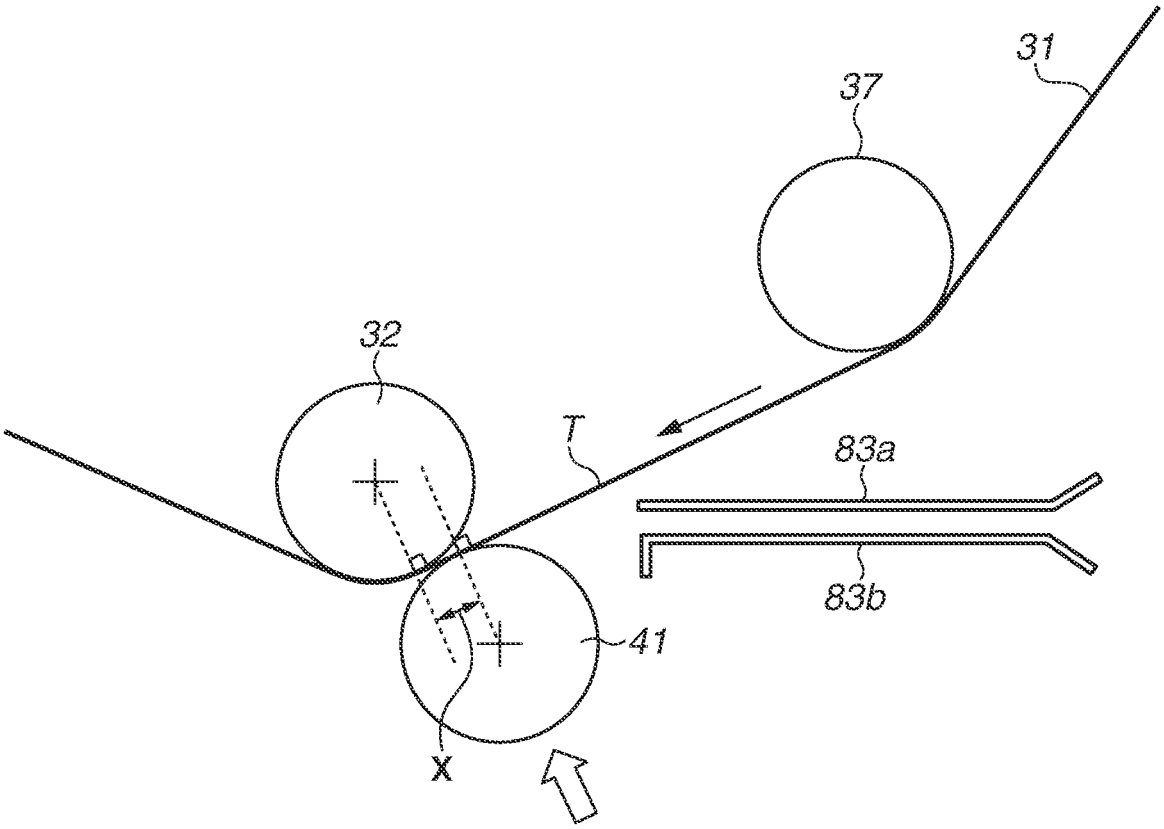
FIG. 2 is a diagram schematically illustrating a configuration in a vicinity of a secondary transfer portion.

In FIG. 2, the secondary transfer roller 41 is disposed to hypothetically come into contact with the stretched line T. However, a material of the secondary transfer roller 41 is an elastic member such as a rubber or a sponge, and the secondary transfer roller 41 is actually pressed in an arrow direction and is deformed.

The secondary transfer roller 41 is offset from the opposed roller 32 on an upstream side in a traveling direction of the intermediate transfer belt 31. Further, the secondary transfer roller 41 is pressed so as to nip the intermediate transfer belt 31, whereby the S-shaped secondary transfer nip (secondary transfer portion) is formed. Further, a sheet posture of the sheet material S guided and fed by a pre-secondary-transfer guide 83 is determined to suit a shape of the nip.

The sheet material S is bent more as the offset distance X is made larger. As a result, in a case of a thin sheet, sheet separability after passage of the secondary transfer nip is improved. However, in a case of a thick sheet, if the offset distance X is large, a trailing end of the sheet material S collides with the stretched line T after passage of the pre-secondary-transfer guide 83, which deteriorates image quality in transferring. Accordingly, in the present exemplary embodiment, the offset distance X is changeable based on a basis weight of the sheet material S as described below.

Figure 3A:
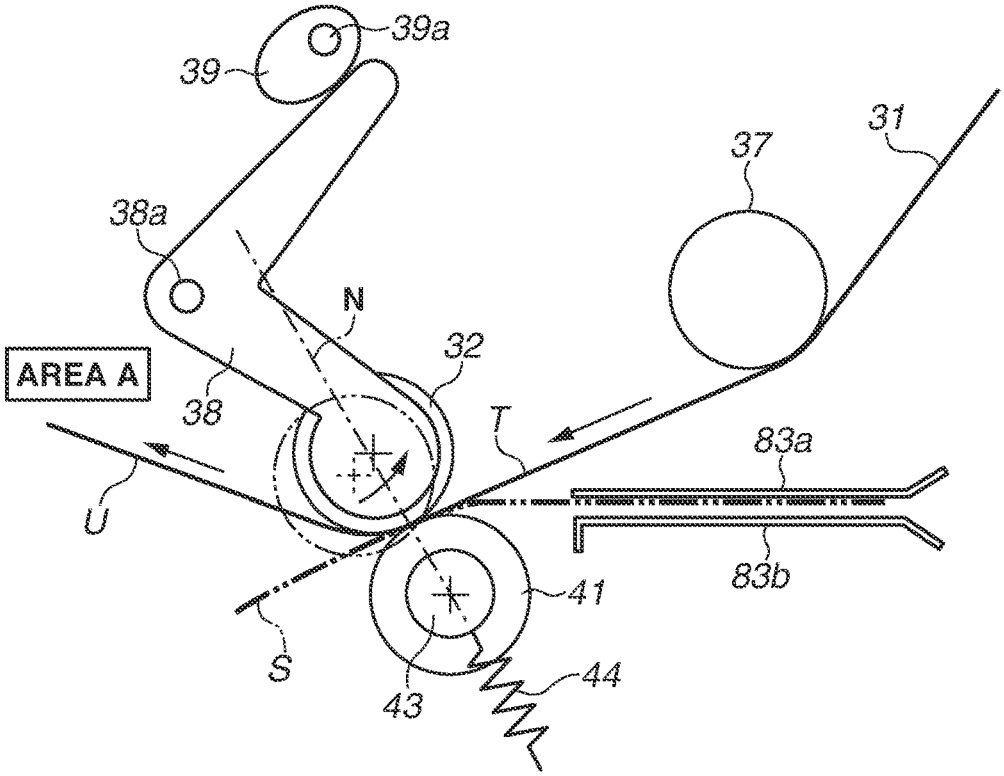
FIGS. 3A and 3B are diagrams schematically illustrating a configuration in a vicinity of a secondary transfer portion according to a first exemplary embodiment.
Figure 3B:
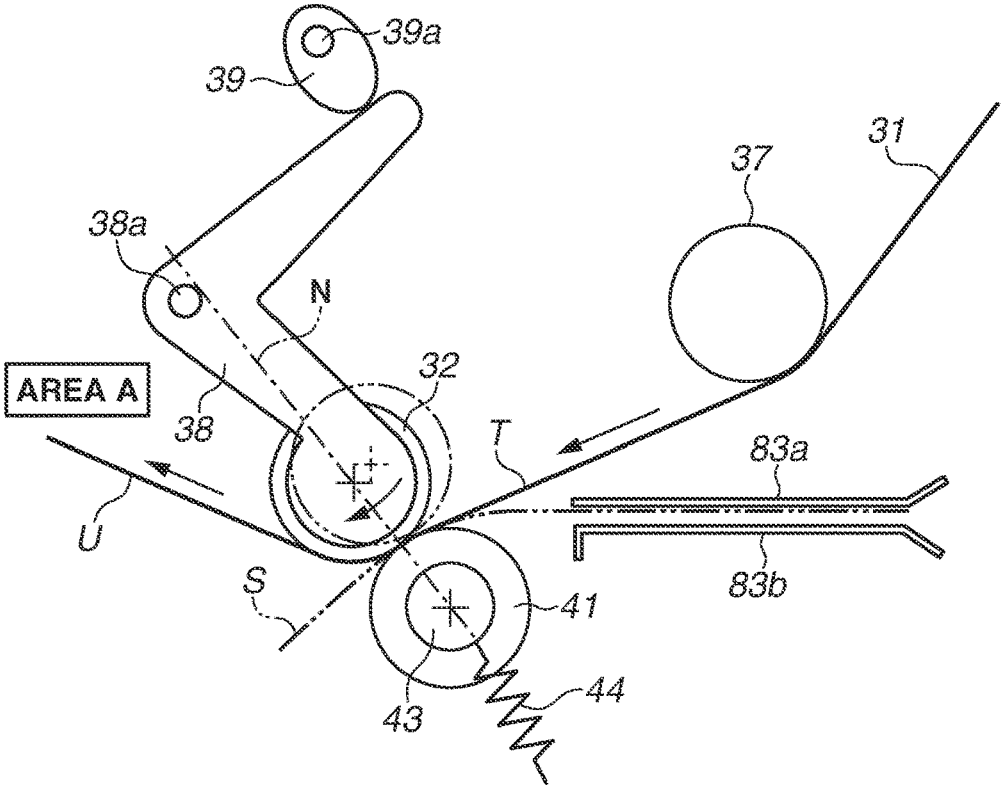

FIGS. 3A and 3B are diagrams schematically illustrating the secondary transfer portion according to the present exemplary embodiment. FIG. 3A illustrates a state of the secondary transfer portion in a case where the sheet material S is a thick sheet, and FIG. 3B illustrates the state of the secondary transfer portion in a case where the sheet material S is a thin sheet.

Separating Mechanism of Secondary Transfer Portion

Each of both end parts of the secondary transfer roller 41 is rotatably supported by a bearing 43. The bearing 43 is supported to be slidable in a predetermined direction toward the opposed roller 32. The secondary transfer roller 41 comes into contact with the opposed roller 32 with the intermediate transfer belt 31 in between by being pressed against the opposed roller 32 by a pressing member 44, thereby forming the secondary transfer nip.

In the present exemplary embodiment, to avoid the toner from adhering to the surface of the secondary transfer roller 41 when image transfer to the sheet material S is not performed, for example, when a patch image for image density correction and color deviation correction is formed, a separating mechanism that moves the secondary transfer roller 41 in a direction away from the opposed roller 32 is provided. Further, if the secondary transfer roller 41 is continuously pressed against the opposed roller 32 after an image formation job ends, the opposed roller 32 and the secondary transfer roller 41 may be deformed, Thus, the secondary transfer roller 41 and the opposed roller 32 are separated from each other when the image formation ends.

Offset Mechanism of Secondary Transfer Portion

In the present exemplary embodiment, there is provided a position changing mechanism that changes a position of the opposed roller 32 relative to a circumferential direction of the secondary transfer roller 41 based on information about the thickness of the recording medium. The detail thereof is described below. In the present exemplary embodiment, both end parts of the opposed roller 32 are rotatably supported by an opposed roller holder 38 serving as a support member (arm member). The opposed roller holder 38 includes a rotating shaft 38*a*. The opposed roller holder 38 is rotatably supported about the rotating shaft 38*a*. As described above, in the present exemplary embodiment, the opposed roller holder 38 that rotatably supports the opposed roller 32 is rotated about the rotating shaft 38*a* to move the position of the opposed roller 32 relative to the secondary transfer roller 41. This makes it possible to prevent operation failure compared with a case where the opposed roller 32 is slid. In the case where the opposed roller 32 is slid, for example, a possible configuration may include a boss fitting in a slide groove so that the opposed roller 32 is slid. In this case, the opposed roller 32 is slid in a sliding direction while the boss is sandwiched between and is in point contact with an upper part and a lower part of the groove. Accordingly, the boss is slid, whereby surface property is deteriorated and the operation failure may be caused. On the other hand, in the configuration in which the opposed roller holder 38 is rotated about the rotating shaft 38*a* as in the present exemplary embodiment, the rotating shaft 38*a* is in surface contact with a fitting hole and is rotatably supported. As a result, abrasion caused by sliding can be suppressed compared with the case of sliding the opposed roller 32, and it is possible to stabilize operation through durability. In the exemplary embodiment, in a cross section perpendicular to the rotating shaft 38*a*, the rotating shaft 38*a* is provided on an outside of an outer peripheral surface of the opposed roller 32 and on an inside of the inner peripheral surface of the intermediate transfer belt 31.

The opposed roller holder 38 is configured to be rotated by action of a cam 39 as a rotating mechanism. The cam 39 is supported so as to be rotatable about a cam rotary shaft 39*a*, and is rotatable about the cam rotary shaft 39*a* by being driven by a driving source (not illustrated) such as a motor. In the present exemplary embodiment, the opposed roller holder 38, the cam 39, and the motor that drives the cam 39 function as an offset mechanism (position changing mechanism). In the present exemplary embodiment, in the opposed roller holder 38, the position of the rotating shaft 38*a* of the opposed roller holder 38 is set so that moment in a counterclockwise direction is constantly applied to the rotating shaft 38*a* by a force received from the secondary transfer roller 41 and tension of the intermediate transfer belt 31. In the present exemplary embodiment, a position of a rotation center of the opposed roller 32 relative to the circumferential direction of the secondary transfer roller 41 is changeable (offsetable) based on the basis weight of the recording medium described below. In the present exemplary embodiment, the position of the rotating shaft 38*a* of the opposed roller holder 38 is located on the same side of a straight line N connecting a center of the secondary transfer roller 41 and a center of the opposed roller 32, irrespective of the offset amount of the position of the rotation center of the opposed roller 32. In the present exemplary embodiment, the rotating shaft 38*a* of the opposed roller holder 38 is disposed on the downstream side of the straight line N connecting the center of the secondary transfer roller 41 and the center of the opposed roller 32, in a conveyance direction of the sheet material S. As a result, the force received from the secondary transfer roller 41 becomes moment in the counterclockwise direction. This makes it possible to configure a cam mechanism without using a pressing member such as a spring.

It is desirable to dispose the opposed roller holder 38 on an inside of a stretched line of the intermediate transfer belt 31 in order not to inhibit workability of attaching or replacing the intermediate transfer belt 31 in an intermediate transfer belt unit. In other words, the rotating shaft 38*a* of the opposed roller holder 38 is provided on the inside of the intermediate transfer belt 31. Thus, the rotating shaft 38*a* is disposed in an area A between the above-described straight line N and a stretched line U of the intermediate transfer belt after the secondary transfer nip.

In a case where the sheet material S is a thick sheet as illustrated in A, the opposed roller holder 38 rotates in the counterclockwise direction about the rotating shaft 38*a* to position the opposed roller 32. This makes the offset distance X small, and prevents deterioration of image quality at the trailing end of the thick sheet.

In a case where the sheet material S is a thin sheet as illustrated in FIG. 3B, the opposed roller holder 38 rotates in a clockwise direction about the rotating shaft 38*a* to position the opposed roller 32. This makes the offset distance X large, and separability of the thin sheet after passage of the secondary transfer nip is improved. In the present exemplary embodiment, the offset distance is set to positive when the sheet material S is the thin sheet.

In the image forming apparatus 100 according to the present exemplary embodiment, the upstream offset distance X is set to the following two patterns based on a basis weight M of the sheet material S:

(a) if $M \geq 52$ g/m$^2$, then X=1.0 mm, and (b) if $M < 52$ g/m$^2$, then X=2.5 mm.

Figure 4:
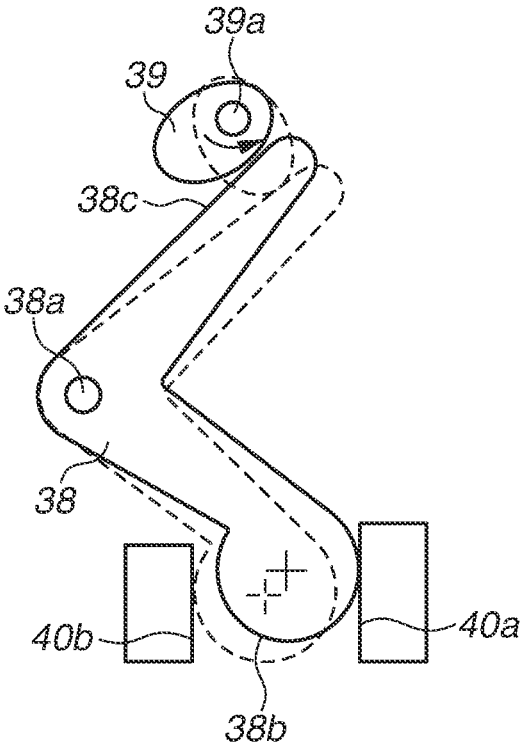
FIG. 4 is a diagram schematically illustrating an opposed roller position varying mechanism according to the first exemplary embodiment.

FIG. 4 is a diagram schematically illustrating an opposed roller position varying mechanism of the secondary transfer portion. A home position of each of the cam 39 and the opposed roller holder 38 is indicated by a solid line. As described above, the opposed roller holder 38 receives the moment in the counterclockwise direction about the rotating shaft 38*a* by the tension of the intermediate transfer belt 31 and the force received from the secondary transfer roller 41. The opposed roller holder 38 includes a cylindrical abutting portion 38*b* that is coaxial with a rotary shaft of the opposed roller 32. The abutting portion 38*b* abuts on a first positioning portion 40*a* at the home position, so that the opposed roller 32 is positioned. The position of the opposed roller holder 38 in the rotating direction is determined in the above-described manner. At the home position, the cam 39 is not in contact with the opposed roller holder 38. In the present exemplary embodiment, the first positioning portion 40*a* is fixed to an apparatus main body so as to abut on the abutting portion 38*b* that is provided on a side opposite to an arm portion 38*c* of the opposed roller holder 38. Accordingly, even if the opposed roller holder 38 has variation in shape, it is possible to suppress positional fluctuation of the opposed roller 32 at the home position. Thus, the position of the opposed roller 32 in the case where the offset distance X is 1.0 mm is determined, and the sheet material S is fed without any change in the case where the sheet material S has the basis weight M of 52 g/m$^2$ or more.

If the sheet material S having the basis weight M of less than 52 g/m$^2$ is fed, the cam 39 rotates as indicated by a dashed line in FIG. 4. When the cam 39 rotates, the cam 39 comes into contact with and presses the arm 38*c* of the opposed roller holder 38, and the abutting portion 38*b* abuts on a second positioning portion 40*b*. Thus, the position of the opposed roller 32 in the case where the offset distance X is 2.5 mm is determined. The opposed roller holder 38 is elastically deformable. Thus, even if a rotation amount and a shape of the cam 39 are individually varied, the opposed roller 32 can be positioned with respect to the second positioning portion 40*b*.

The second positioning portion 40*b* is fixed to the apparatus main body and is positioned. The opposed roller 32 is positioned by abutting on the second positioning portion 40*b*, which is fixed to the apparatus main body. This makes it possible to improve positional accuracy with respect to the apparatus main body. The position of the opposed roller 32 may be controlled by controlling the rotation amount of the cam 39 without providing the second positioning portion 40*b*.

The layout of the rotating shaft 38*a* of the opposed roller holder 38 is described in more detail with reference to FIGS. 5A and 5B. A direction of the force received from the tension of the intermediate transfer belt 31 is indicated by a straight line P, and a direction of the force received from the secondary transfer roller 41 is indicated by the straight line N, The straight line P passes through the rotation center of the opposed roller 32 when the secondary transfer roller 41 is not in contact with the intermediate transfer belt 31. Further, the straight line P passes through a center position of a contact area (belt wound area), where the opposed roller 32 comes in contact with the intermediate transfer belt 31, in the rotation direction of the intermediate transfer belt 31 when the secondary transfer roller 41 is not in contact with from the intermediate transfer belt 31. In other words, the straight line P is a bisector of an angle formed by the stretched line T and the stretched line U of the intermediate transfer belt 31 when the secondary transfer roller 41 is not in contact with the intermediate transfer belt 31. In the present exemplary embodiment, the secondary transfer roller 41 is separated from the intermediate transfer belt 31 when the opposed roller 32 is located at the home position. The stretched line T is the stretched line of the intermediate transfer belt 31 stretched between the opposed roller 32 and the pre-secondary-transfer roller 37 that is adjacent to the opposed roller 32 on the upstream side in the rotation direction of the intermediate transfer belt 31. The stretched line U is the stretched line of the intermediate transfer belt 31 stretched between the opposed roller 32 and the driving roller 33 that is adjacent to the opposed roller 32 on the downstream side in the rotation direction of the intermediate transfer belt 31.

Figure 5A:
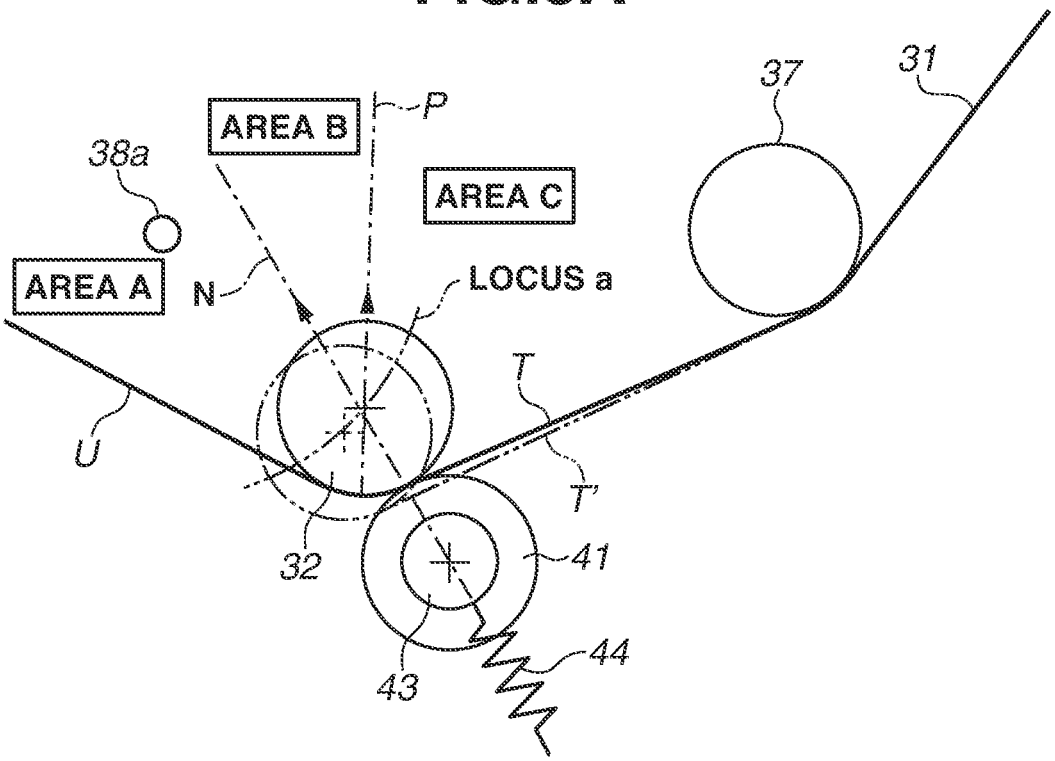
FIGS. 5A and 5B are views each schematically illustrating a layout of a rotating shaft of an opposed roller holder.

In the present exemplary embodiment, as illustrated in FIG. 5A, the rotating shaft 38*a* is located in the area A sandwiched between a straight line U extended from the stretched line U and the straight line N irrespective of a phase to which the opposed roller holder 38 is set as described above. In this case, the position of the opposed roller 32 is changed along a locus a. Accordingly, a stretch angle of the stretched line T of the intermediate transfer belt 31 before the secondary transfer nip is also changed to that of a stretched line T'.

Figure 5B:
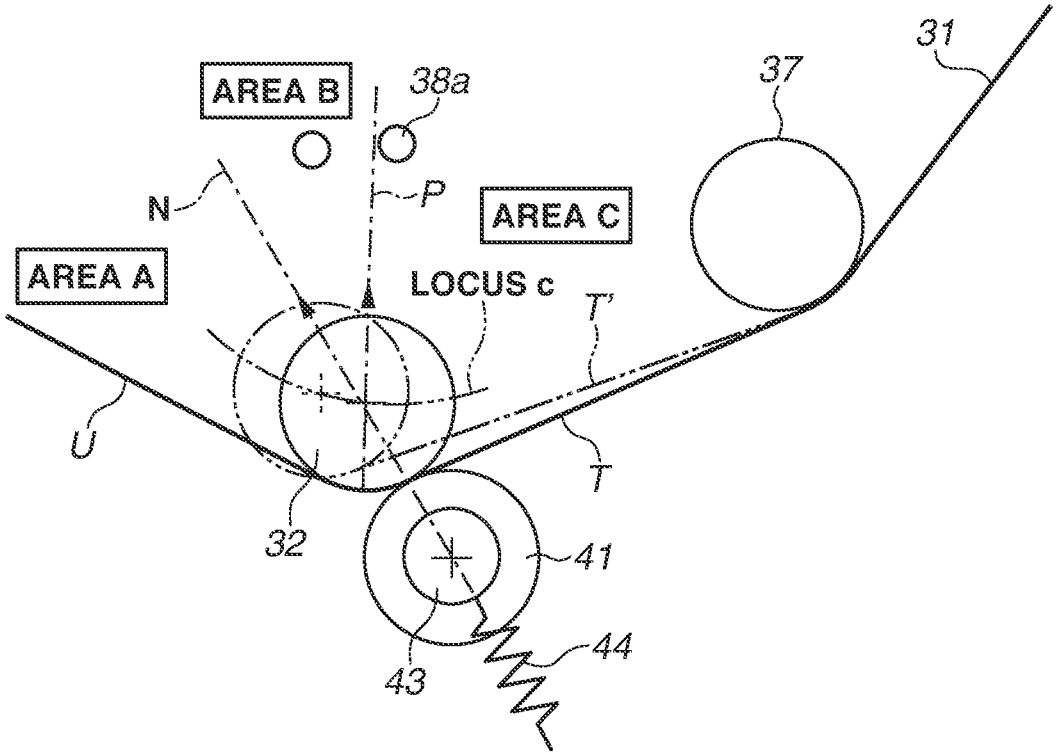

A case is described where the rotating shaft 38*a* is tentatively disposed in an area C formed by the straight line P and the straight line T (solid line) as illustrated in FIG. 5B. In this case, both the moment caused by the tension of the intermediate transfer belt 31 and the moment caused by the force received from the secondary transfer roller 41 are received in the clockwise direction. Thus, in the case illustrated in FIG. 5B, it is unnecessary to add another pressing member to urge the opposed roller holder 38 in one direction as with the case illustrated in FIG. 5A. At this time, the position of the opposed roller 2 is changed along a locus c. Accordingly, the stretch angle of the stretched line T is also changed to that of the stretched line T'. However, an amount of change thereof is larger than the amount of change thereof in the case where the rotating shaft 38*a* is located in the area A.

It is necessary to appropriately set the stretch angle of the stretched line 'I' to prevent image quality deterioration caused by discharge with the sheet material S before entering the secondary transfer nip, and it is desirable that the stretch angle of the stretched line T be not largely changed, Thus, the rotating shaft 38*a* is more desirably disposed in the area A than in the area C. Further, in a case where the rotating shaft 38*a* is disposed in an area B formed by the straight line N and the straight line P (dashed line), the force of the tension of the intermediate transfer belt 31 generates the moment in the counterclockwise direction, whereas the force from the secondary transfer roller 41 generates the moment in the clockwise direction. Accordingly, when the secondary transfer roller 41 is moved to a separated position separated from the intermediate transfer belt 31, the opposed roller holder 38 receives the moment in the counterclockwise direction, whereby the position of the opposed roller holder 38 becomes unstable, To stably apply the moment in either of the directions to configure the cam mechanism, it is necessary to newly add another pressing member such as a spring. Thus, the area A or the area C is more desirable than the area B. In other words, the rotating shaft 38*a* (rotating center) of the opposed roller holder 38 is desirably disposed as follows. The rotating shaft 38*a* of the opposed roller holder 38 is desirably disposed outside an area sandwiched between the straight line N in FIG. 5A and the straight line N in FIG. 5B. Further, in the present exemplary embodiment, the offset distance X is set to a positive value in any case; however, the offset distance X is not limited thereto. The offset distance X may be set to any one of positive and negative values.

Finally, an urging direction of the secondary transfer roller 41 is described. In the present exemplary embodiment, the bearings 43 that rotatably support the respective end parts of the secondary transfer roller 41 are supported to be slidable in the predetermined direction toward the opposed roller 32 as described above. Further, each of the bearings 43 is urged by the pressing member 44 in the predetermined direction. At this time, to substantially keep pressure applied to the secondary transfer nip when the position of the center of the opposed roller 32 is changed, the following configuration is used in the present exemplary embodiment. More specifically, a straight line that passes through a rotation center of the secondary transfer roller 41 along a sliding direction of the secondary transfer roller 41 is set to intersect a moving locus of the rotation center of the opposed roller 32.

In the first exemplary embodiment, the offset distance X is set to the two patterns based on the basis weight M of the sheet material S. Alternatively, for example, the offset distance X may be set to three patterns:

(a) if $M \geq 350$ g/m$^2$, then X=0 mm, (b) if 52 g/m$^2 \leq M < 350$ g/m$^2$, then X=1.0 mm, and (c) if $M < 52$ g/m$^2$, then X=2.5 mm.

Figure 6:
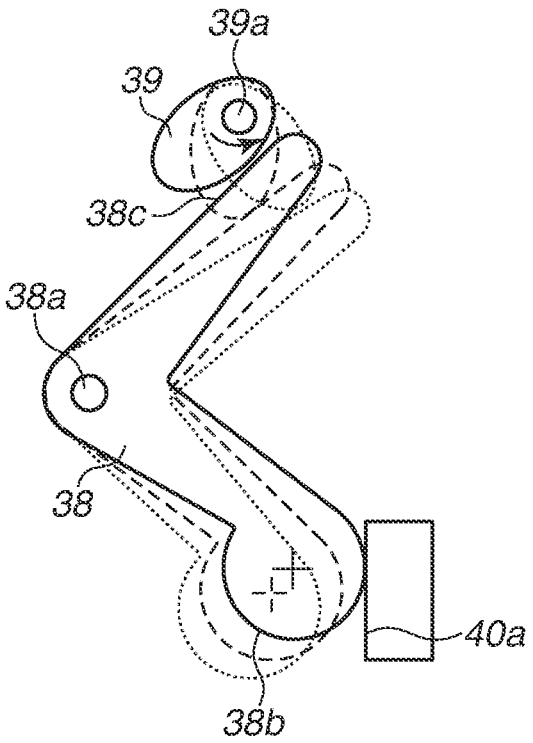
FIG. 6 is a diagram schematically illustrating an opposed roller position varying mechanism according to a second exemplary embodiment.

FIG. 6 is a diagram schematically illustrating an opposed roller position varying mechanism of a secondary transfer portion according to a second exemplary embodiment. When the offset distance X of 0 mm at which the abutting portion 38*b* abuts on the first positioning portion 40*a* is set as the home position, the offset distance X of 1.0 mm (dashed line in figure) and the offset distance X of 2.5 mm (dotted line in figure) are positioned based on the phase of the cam 39.

In the present exemplary embodiment, the example in which the offset distance X is set to the three patterns has been illustrated. However, the offset distance X can be set to four or more patterns by changing the phase of the cam 39 in a similar manner.

Figure 7:
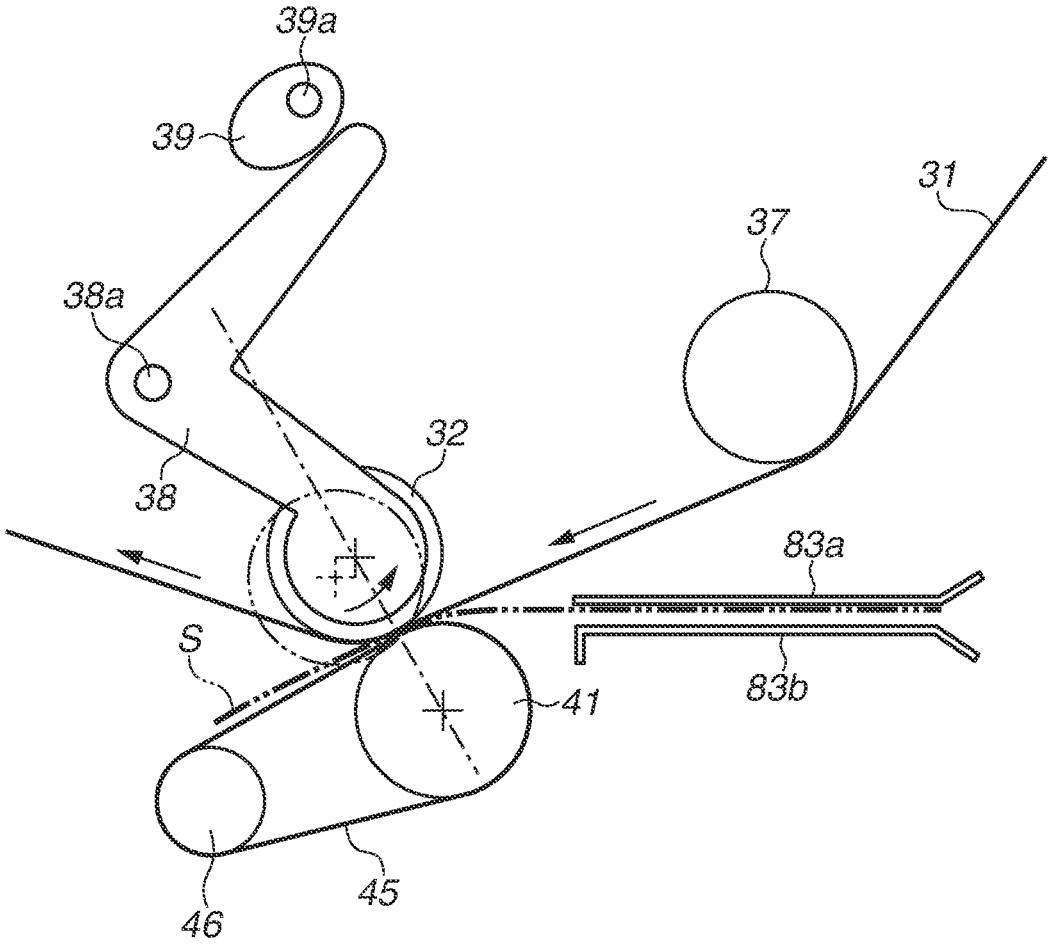
FIG. 7 is a diagram schematically illustrating a configuration in a vicinity of a secondary transfer portion according to a third exemplary embodiment.

FIG. 7 is a diagram schematically illustrating a secondary transfer portion according to a third exemplary embodiment. In the present exemplary embodiment, as the secondary transfer member, a secondary transfer belt 45 stretched by a secondary stretching roller 46 and the secondary transfer roller 41 is used. The secondary transfer nip is a nip portion between the opposed roller 32 on a back surface of the intermediate transfer belt 31 and the secondary transfer roller 41 on a back surface of the secondary transfer belt 45.

The offset distance X is defined by the position of the opposed roller 32 and a relative position of the secondary transfer roller 41, and the offset distance X is changed by the position varying mechanism of the opposed roller 32, similar to the above-described position varying mechanism, based on the basis weight M of the sheet material S.

In the first to third exemplary embodiments, the configuration in which the rotation center of the opposed roller 32 is rotationally moved by the opposed roller holder 38 has been described as an example; however, the configuration is not limited thereto. For example, a secondary transfer roller holder that rotationally moves a position of the rotation center of the secondary transfer roller 41 may be provided to change the position of the opposed roller 32 and the relative position of the secondary transfer roller 41. In this case, a separating mechanism that slidably supports the opposed roller 32 to bring the opposed roller 32 into contact with the secondary transfer roller 41 and to separate the opposed roller 32 from the secondary transfer roller 41 may be provided.

In the exemplary embodiments, the position of the opposed roller 32 is variable based on the basis weight of the sheet material. Alternatively, the position of the opposed roller 32 may be varied based on a thickness of the sheet material.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s), The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-061554, filed Mar. 27, 2019, which is hereby incorporated by reference herein in its entirety.

What is claimed is:

1. An image forming apparatus comprising:

an image bearing member;

an image forming portion configured to form a toner image on the image bearing member;

an intermediate transfer belt to which the toner image is to be transferred from the image bearing member;

a plurality of rollers configured to stretch the intermediate transfer belt, wherein the plurality of rollers includes an inner roller provided in contact with an inner surface of the intermediate transfer belt;

an outer roller forming a transfer nip to transfer the toner image from the intermediate transfer belt to a recording medium in cooperation with inner roller; and a pair of arm members configured to rotatably support the inner roller and provided to be rotatable about a rotating shaft, wherein, by rotating the pair of arm members, the inner roller is movable to a first rotating position and a second rotating position different from the first rotating position, wherein, when the inner roller is positioned at the first rotating position, the transfer nip is formed at a first transfer nip position in a circumferential direction of the outer roller, wherein, when the inner roller is positioned at the second rotating position, the transfer nip is formed at a second transfer nip position that is different from the first transfer nip position and is in the circumferential direction of the outer roller, and wherein the rotating shaft is disposed inside the intermediate transfer belt.

2. The image forming apparatus according to claim 1, wherein the plurality of rollers includes a downstream roller provided downstream of the inner roller and adjacent to the inner roller in a rotation direction of the intermediate transfer belt, wherein the rotating shaft is disposed in an area between a straight line N and a straight line U extended from a stretched line of the intermediate transfer belt stretched between the inner roller and the downstream roller, and wherein the straight line N passes through a rotation center of the inner roller and a rotation center of the outer roller.

3. The image forming apparatus according to claim 1, wherein the outer roller is configured to contact the intermediate transfer belt and separate from the intermediate transfer belt.

4. The image forming apparatus according to claim 1, further comprising:

a supporting unit configured to support the outer roller to be slidable in a predetermined direction; and an urging member configured to urge the outer roller toward the inner roller, wherein a straight line that passes through a rotation center of the outer roller along the predetermined direction intersects a moving locus of a rotation center of the inner roller when the pair of arm members rotates between the first rotating position and the second rotating position.

5. The image forming apparatus according to claim 1, further comprising:

a pair of cams configured to rotate the pair of arm members; and a positioning portion configured to position the pair of arm members in a rotating direction by coming into contact with the pair of arm members, wherein, when the pair of arm members are at the first rotating position, the pair of arm members are separated from the pair of cams and are brought into contact with the positioning portion by force applied from the intermediate transfer belt.

6. The image forming apparatus according to claim 5, wherein, when the pair of arm members are at the second rotating position, the pair of arm members are brought into contact with the pair of cams, and a position of the pair of arm members are determined by the pair of cams.

7. The image forming apparatus according to claim 1, further comprising:

a rotating mechanism configured to rotate the pair of arm members; and a controller configured to control the rotating mechanism so that a position of the transfer nip in the circumferential direction of the outer roller changes based on a basis weight of the recording medium.

8. The image forming apparatus according to claim 1, wherein the plurality of rollers includes an upstream roller provided upstream of the inner roller and adjacent to the inner roller in a rotation direction of the intermediate transfer belt, wherein the rotating shaft is disposed in an area between a straight line P and a straight line T extended from a stretched line of the intermediate transfer belt stretched between the inner roller and the upstream roller, and wherein the straight line P passes through a center of a contact area where the inner roller and the intermediate transfer belt come into contact with each other in the rotation direction of the intermediate transfer belt and through a rotation center of the inner roller.

* * * * *